US006651842B2

(12) United States Patent
Collins et al.

(10) Patent No.: US 6,651,842 B2
(45) **Date of Patent: *Nov. 25, 2003**

(54) ARTICLE DISPENSING MACHINE AND METHOD

(75) Inventors: Jeremiah F. Collins, Boylston, MA (US); Fredrick P. Donth, Fitchburg, MA (US); James B. Hills, Holden, MA (US)

(73) Assignee: DT Industries, Inc., Leominister, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/109,681

(22) Filed: Apr. 1, 2002

(65) Prior Publication Data

US 2002/0113076 A1 Aug. 22, 2002

Related U.S. Application Data

(63) Continuation of application No. 09/679,073, filed on Oct. 5, 2000.

(51) Int. Cl.[7] ..... B65H 3/36

(52) U.S. Cl. ..... 221/253; 198/483.1; 198/803.14; 198/708; 198/445

(58) Field of Search ..... 198/483.1, 803.14, 198/708, 445; 221/76, 81, 82, 233, 234, 273, 253

(56) References Cited

U.S. PATENT DOCUMENTS 423,069 A * 3/1890 Miller
614,847 A * 11/1898 Dick
690,934 A * 1/1902 Dick
736,901 A * 8/1903 Willson, Jr.
853,129 A * 5/1907 Simpson
1,224,445 A * 5/1917 Burpee
2,109,301 A * 2/1938 Nakane
2,290,981 A * 7/1942 Maguire et al.
2,541,632 A * 2/1951 Baugh
2,652,791 A * 9/1953 Liston
2,664,592 A * 1/1954 Ingraham et al.
2,693,268 A * 11/1954 Ball
3,034,638 A * 5/1962 Franz
3,354,607 A * 11/1967 Lakso
3,388,786 A * 6/1968 Thomson
3,680,927 A * 8/1972 Neureuther
3,770,106 A * 11/1973 Kuehl et al.
3,807,548 A * 4/1974 Bergeron
3,860,107 A * 1/1975 Cioni et al.
3,925,960 A * 12/1975 Saari et al.
4,017,003 A * 4/1977 Heino ..... 221/81
4,406,036 A * 9/1983 Nijhuis
4,537,658 A * 8/1985 Albert
4,542,821 A * 9/1985 Livermore
4,678,078 A * 7/1987 Hastem-Muller
4,776,454 A * 10/1988 Momose
5,054,258 A * 10/1991 Tait et al.
5,287,957 A * 2/1994 Iuchi et al.
5,316,133 A * 5/1994 Moser
5,346,050 A * 9/1994 Mojden et al.
5,346,060 A * 9/1994 Ferguson
5,549,195 A * 8/1996 Aulagner et al.
5,706,934 A * 1/1998 Palmaer et al.
6,422,418 B1 * 7/2002 Collins et al. ..... 221/253

* cited by examiner

*Primary Examiner*—David H. Bollinger
(74) *Attorney, Agent, or Firm*—Blackwell Sanders Peper Martin LLP

(57) ABSTRACT

An article dispensing apparatus is described. The dispensing apparatus includes a plurality of slats, each having one or more holders for holding and dispensing articles. Each slat has a cavity and an open end. Further, each holder includes an aperture through which a pin may extend into and retract from the cavity to assist in dispensing articles held therein. Each open end may include a curved surface to assist in inhibiting the articles from being dispensed prematurely. Further, each slat may include a tongue on one side and a groove on another side. The tongues of each slat fit within the grooves of adjacent slats, allowing them to ride in close conformity to each other and allowing for relatively unencumbered movement between the slats.

29 Claims, 4 Drawing Sheets

ARTICLE DISPENSING MACHINE AND METHOD

CROSS REFERENCE TO RELATED APPLICATIONS

The present application is a continuation application of U.S. patent application Ser. No. 09/679,073 filed on Oct. 5, 2000, the disclosure of which is herewith incorporated by reference entirety.

BACKGROUND

In a known article dispensing machine, the articles are fed from a hopper into open-ended cavities in a holder. The holder is moved to a discharge station where it is tilted for discharge of the articles from the cavities. The holder includes a plurality of elongated slats provided with the cavities which are conveyed in a succession transversely of their length from the feeding station to the discharging station, where the holders are tilted for discharge of their contents to a succession of containers moved past the station. The known article dispensing machine is shown in U.S. Pat. Nos. 3,354,607 and 3,925,960.

With machines of the foregoing general type, difficulty has been experienced with occasional articles being stuck in the cavity so that they do not discharge under gravity at the discharge station. Sometimes the articles are oversize. Sometimes they become wedged into the cavity by dust particles or pieces or chips broken off the articles. This difficulty is particularly troublesome where complete discharge is requisite for accurate count, since an error in the count is thereby produced which may continue through many cycles before the condition is detected.

SUMMARY

The invention relates to an article dispensing apparatus having a feeding station and a discharge station. The dispensing apparatus includes a conveyor, which has a plurality of holders each having at least one cavity adapted to receive at least one article, each holder having an open end. The dispensing apparatus further includes a conveying device adapted to convey the holders around a circuit, the circuit including areas where the holders are conveyed about an axis. The dispensing apparatus also has an article feeding device adapted to feed articles to the holders at the feeding station and a chute positioned at the discharge station and having an arcuate portion facing the open ends of the holders. The open ends of the holders include a surface complementary to the arcuate portion for inhibiting articles within the holders from being dispensed at a location other than the discharge station.

The invention also relates to an article dispensing apparatus having a feeding station and a discharge station, which includes a conveyor and an article feeding device adapted to feed articles to holders at the feeding station. The conveyor includes a plurality of elongated holders connected for movement in a direction transverse to their length, each holder having a tongue on one side and a groove on another side. The conveyor also includes a conveying device adapted to convey the holders around a circuit, the circuit including areas where the holders are conveyed about an axis. Each tongue fits within a respective groove of an adjacent holder allowing the holders to ride in close conformity around the circuit.

These and other advantages and features of the invention will be more readily understood from the following detailed description which is provided in connection with the accompanying drawings.

DETAILED DESCRIPTION OF PREFERRED EMBODIMENTS

Figure 1:
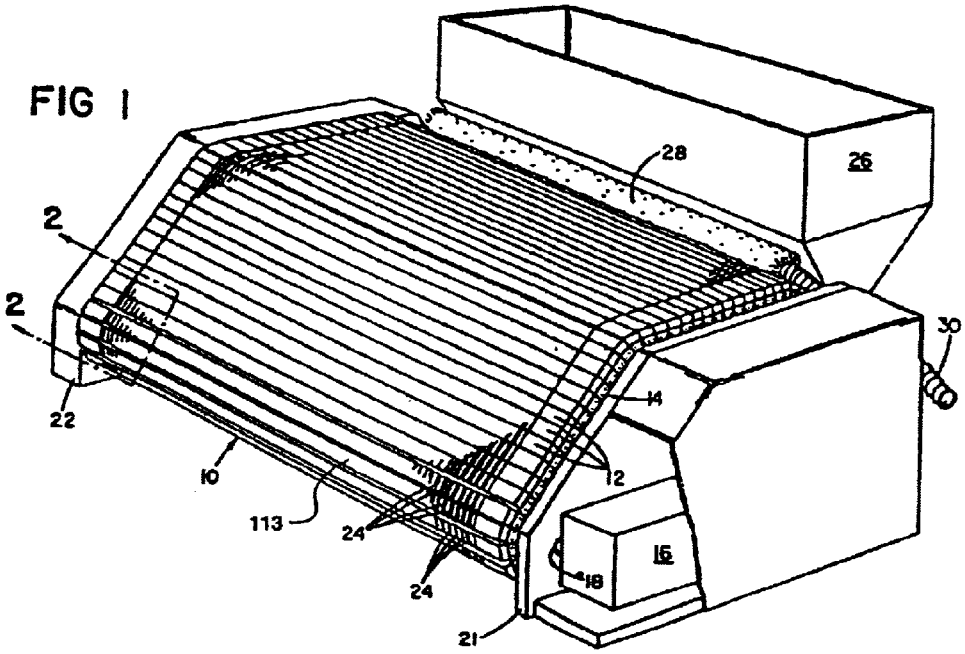
FIG. 1 is a partially broken away perspective view of a dispensing apparatus constructed in accordance with a preferred embodiment of the invention.
Figure 2:
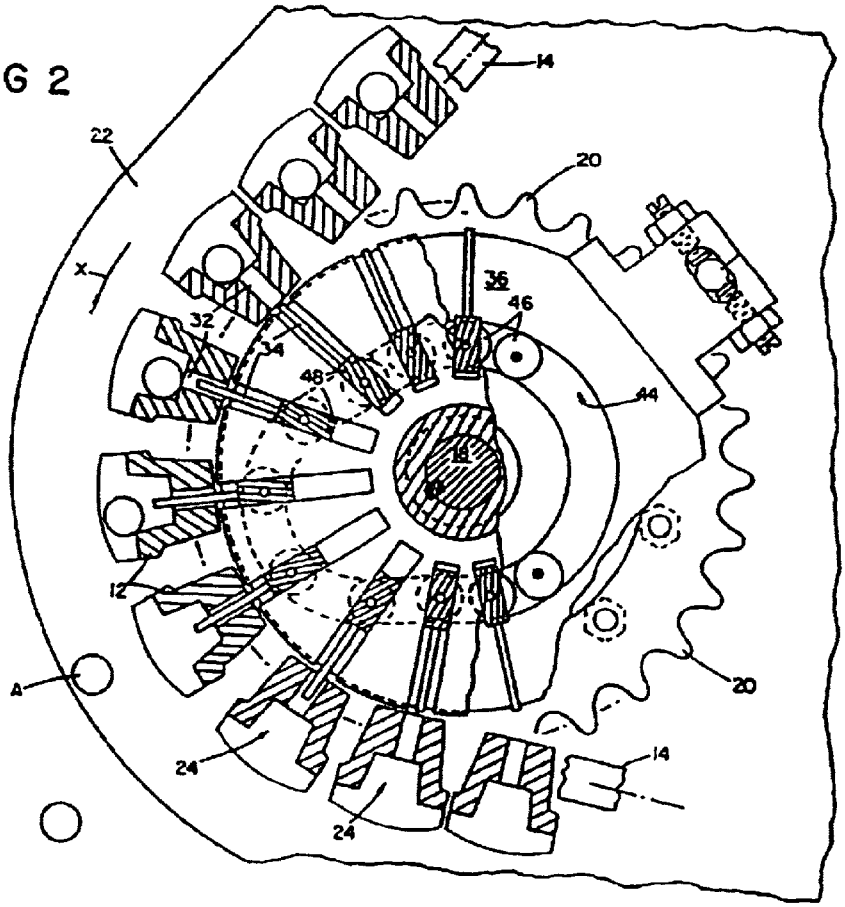
FIG. 2 is a cross-sectional view taken along line 2—2 of the dispensing apparatus of FIG. 1.

Referring now to the drawings, there is shown in FIGS. 1 and 2 a conveyor generally designated 10 which is made up of elongated slats 12 mounted with their long sides contiguous with one another and mounted on the links of end chains 14. The chains 14 are mounted on sprockets 20 (FIG. 3) so that the conveyor 10 moves in a direction transverse of the slats 12 from the right hand end in FIG. 1, which is the back of the apparatus, to the left hand front of the apparatus, over the top and returning underneath and up in an endless path. A motor 16 has a drive shaft 18 connected to drive the sprockets 20 at the left hand end of the apparatus in FIG. 1. The shaft 18 extends rotatably through end frames 21 and 22 of the apparatus.

Some or all of the slats 12 are provided with a longitudinal row of adjacent open-ended cavities 24 each adapted to receive one or more articles to be dispensed, the rows extending the full length of the slats 12 except for short blank end portions. Some or all the slats 12 are provided with cavities 24 although for simplicity of illustration they are only partially shown in FIG. 1. Articles A, for which the cavities 24 are adapted to receive and dispense, may be of any configuration. It is to be understood that slats with cavities adapted to other articles of various sizes and shapes, or intermittent slats without cavities, may be substituted. The articles A are supplied to the slat cavities 24 at a feeding station, such as, for example, through a vibratory hopper 26 at the back of the apparatus as the conveyor 10 moves upwardly in an inclined path between lower and upper sprockets (not shown).

Figure 5:
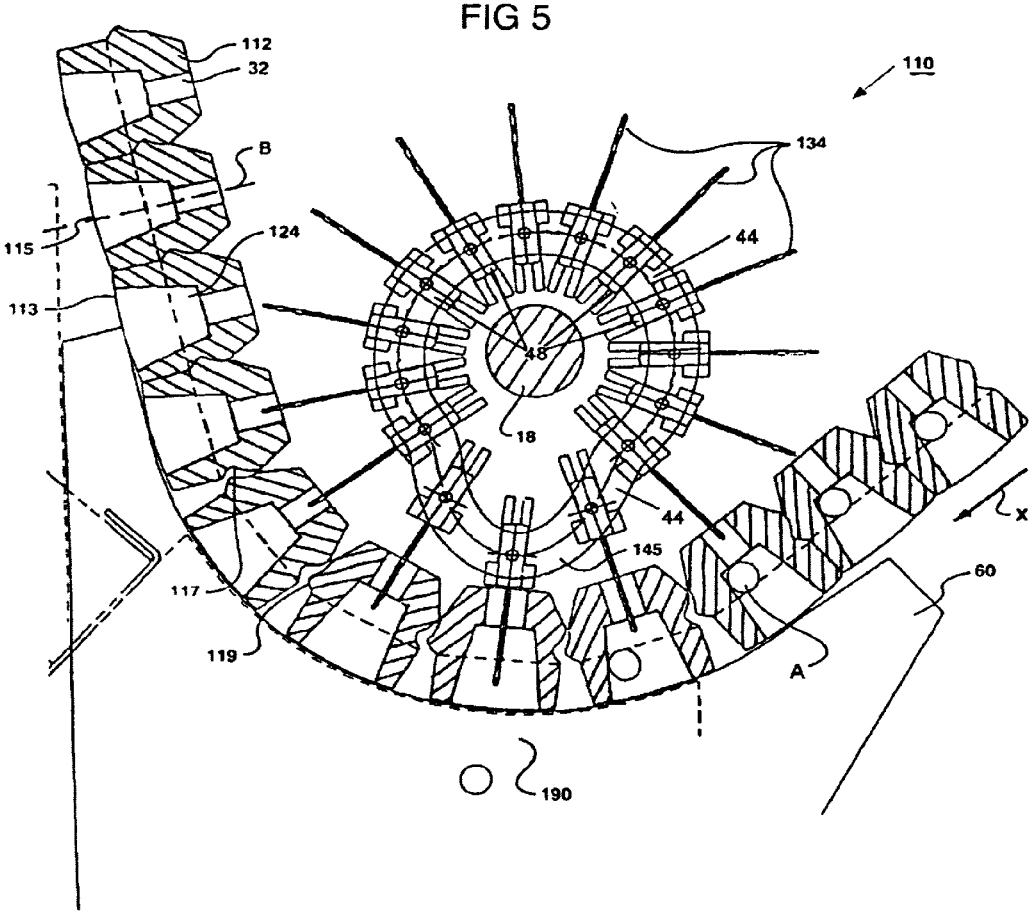
FIG. 5 is a partially broken away perspective view of a dispensing apparatus constructed in accordance with another preferred embodiment of the invention.

A rotary brush 28 downstream from the hopper 26, having a tube 30 for connection to a suction system (not shown) for dust removal, removes excess articles A that are not accommodated in the cavities. At the front end of the conveyor 10, the slats 12 are tilted so that the articles A are dispensed from the open ends of cavities 24 by gravity. Suitable receiving equipment is preferably provided at a discharge station 190, which is shown in FIG. 5. As the conveyor 10 moves from the brush 28 to the discharge station, the cavities 24 may be inspected for undesired vacancies. The inspection may be either visually or by automatic means so that steps may be taken to correct the error in count that would otherwise occur.

The apparatus is provided with a system for ejecting from the slat cavities 24, while the slats 12 are tilted, any articles A which may have become wedged or otherwise stuck in their cavities 24. Preferably where feasible, and as shown in FIG. 2 now to be described, the system acts on the slat cavities 24 while the chains 14 are passing over the sprockets 20 and the slats 12 are being tilted for gravity discharge of the articles A.

Referring to FIG. 2, each cavity 24 of each slat 12 is provided with an opening 32 extending centrally through its end opposite its open end and through the opposite face of the slat. As chains 14 pass downwardly over the sprockets 20, ejector pins 34 of smaller diameter than openings 32 are projected through the openings 32 into the interior of the cavity 24 sufficiently to force out any article A that is stuck in a cavity 24 so that it does not respond to gravity discharge, and are then withdrawn from the openings 32, by a cam arrangement now to be described.

The structure shown at one end of the discharge station 190 (FIG. 5) of the apparatus is duplicated at the opposite end, except that the drive shaft 18, the end of which is journaled in a bearing on a frame member 22, is connected to motor 16 at its opposite end. This structure comprises a disc loosely surrounding the shaft 18 and fixed to the adjacent frame member 22 by a clamp member. The disc is provided with a cam track 44. Rollers ride within a cam track 44, rotatably mounted on shafts at the adjacent ends of ejector pin bars 48 which extend across the apparatus parallel to the slats 12. A spider wheel is fixed to the shaft 18 by a key so that the spider wheel is adjacent the inside face of the disc. The wheel is provided with slots having their center lines radial to the axis of shaft 18, and in which the adjacent ends of bars 48 are longitudinally slidable. A drive wheel keyed to shaft 18 is fastened by bolts to the sprocket.

Each bar 48 is provided with a row of ejectors in the form of pins 34 projecting therefrom parallel to the sides of the slot in which the bar 48 slides. Pins 34 correspond in number and spacing to the number and spacing of the openings 32 into the cavities 24 of the slats. As the shaft 18 rotates (counterclockwise, in the direction of arrow X), the slats 12 pass radially about the shaft through an arc on the order of about ninety (90) degrees. The cam track 44 acts on the rollers to guide the bars 48 through this arc, as propelled by spider wheel, with their pins 34 in radial alignment with the openings 32 of one of the slats 12, and so that the bars 48 approach close to the periphery of the disc while the bars 48 are moved through this arc.

Each slat 12 includes a cavity 24 opening up on one side to a curved surface 113 and on the other side to an opening 32. The curved surface 113 is convex, curving in a direction perpendicular to an axis running the length of the slats 12 and curving outwardly from the opening 32 such that an apex 115 of the curved surface 113 coincides with an axis B of each slat 12.

Figure 6:
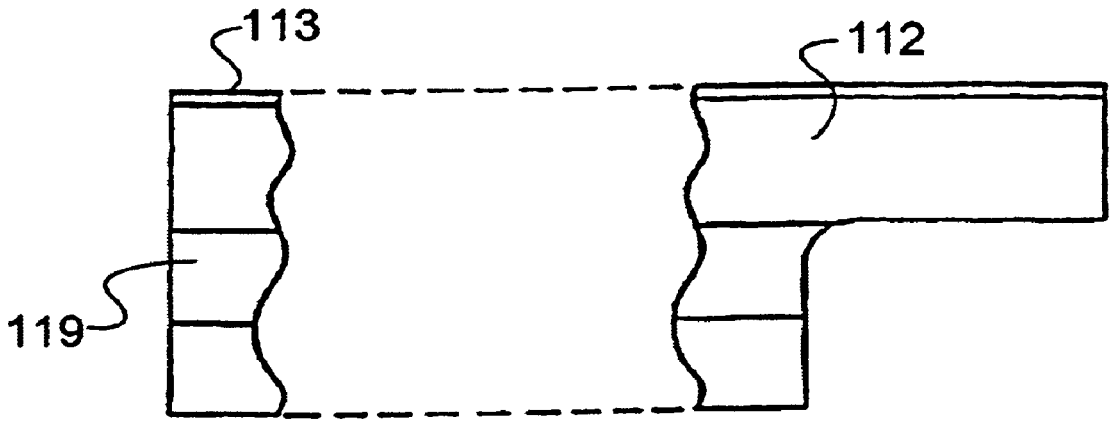
FIG. 6 is a partial front view of an elongated slat of the dispensing apparatus of FIG. 5.

Each slat 112 (FIGS. 5–6), which together form a conveyor 110, includes a dipping groove 117 on one side and a sloping tongue 119 on the other side. Each tongue 119 of each slat 12 fits within a groove 117 of an adjacent slat 12. This tongue-groove arrangement allows each slat 12 to ride in close conformity with adjacent slats 12, even during transitioning between straight runs and turns, and it allows relatively unencumbered movement between adjacent slats 12.

As illustrated, the slats 12 are mounted on end chains 14 (FIG. 1). A motor (not shown) is connected with a drive shaft 18, which drives sprockets, which in turn drive the chains 14, and hence move the slats 12 about a circuit including a feeding station, for example, the hopper 26, and the discharge station 190 (FIG. 5). A cam track 44 revolves around the drive shaft 18 in a similar fashion as described above in reference to FIG. 2. Specifically, the cam track 44 is driven by the spider wheel which is keyed to the shaft 18. The cam track 44 includes a protruding portion 145 which brings the track 44 in closer proximity to the back end of the slats 12 as they pass through the turn approaching the discharge station 190.

Ejector pin bars 48, each of which includes an ejector pin 34, are mounted on the cam track 44. As each of the slats 12 transitions from the straight run into the turn approaching the discharge station 190, a respective one of the ejector pins 34 begins to extend into the opening 32 due to its closer proximity to the slat 12 caused by the protruding portion 145. As the cam track 145 moves closer to the slat 12, the pins 34 are projected progressively through openings 32, entering cavities 24 as the slats 12 each reach a position in which gravity will cause the articles A to roll out of the cavities 24 if they are free to do so.

The ejector pins 34 therefore enter cavities 24 as they are vacated by those articles A which discharge by gravity. However, if an article A is stuck in its slot, it will be engaged by the corresponding ejector pin 34 and ejected in time to join those ejected by gravity, so that no error in count occurs. As the movement continues, the cam track 44 guides the bars 48 so that the pins 34 are progressively withdrawn from openings 32, being removed therefrom by the time the slats 12 move out of radial relation to shaft 18.

The tongue-groove arrangement illustrated in FIG. 2 allows for more seamless movement of each of the slats 12 along the chains 14. The dipping nature of the grooves 117 and the sloping nature of the tongues 119 inhibits any mechanical interference between slats 12 as each transitions into the curved run.

Figure 4:
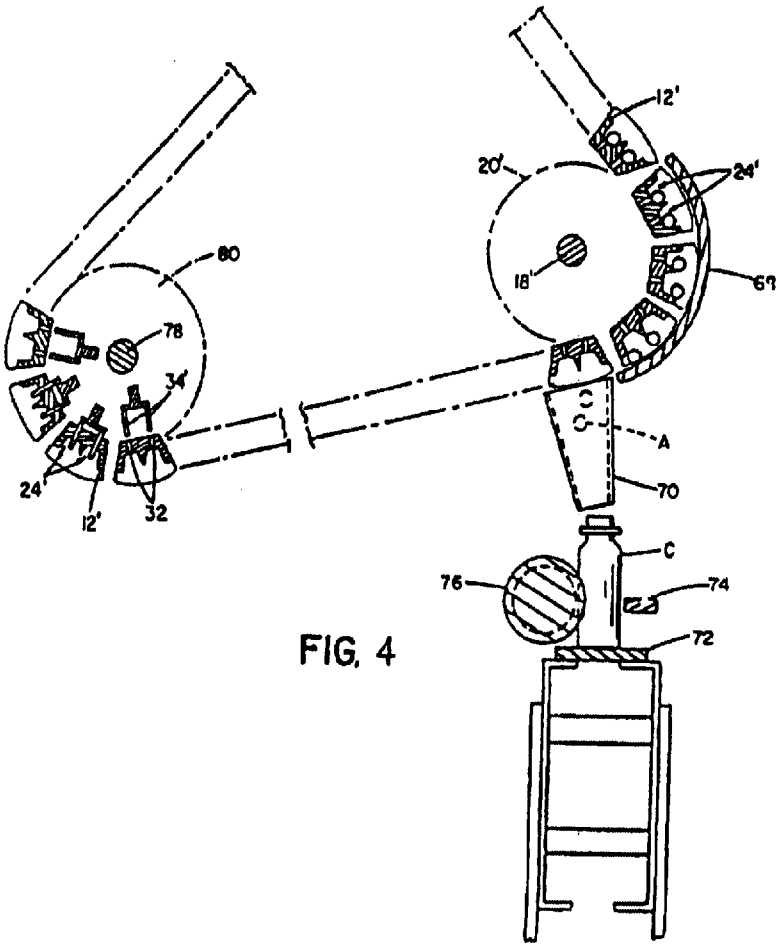
FIG. 4 shows another container filling apparatus constructed in accordance with a preferred embodiment of the invention.
Figure 3:
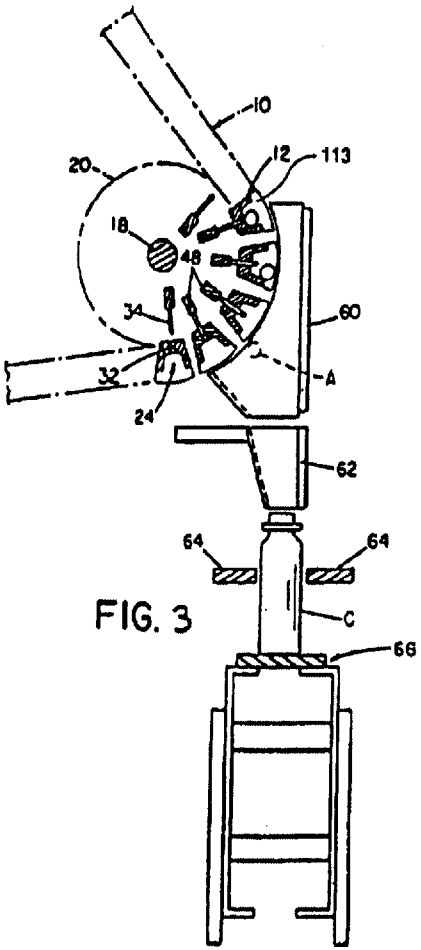
FIG. 3 is a partial side and cross-section view of a dispensing apparatus according to FIG. 1 utilized with one type of container filling apparatus.

The curved surfaces 113 complement the inner, concave surface of either a divider chute 60 (FIGS. 3–5) or a shield member 68 (FIGS. 3–4). Thus, the curved surfaces 113 lessen the amount of free space between each slat 12 and the inner surface of either the divider chute 60 or the shield member 68. Further, the curvature of the surfaces 113 up to the apexes 115 inhibits articles A from moving from one cavity 24 in a first slat 12 to another cavity 24 in a second slat 12. In this way, articles A are retained in their respective cavities 24, which increases the yield of the articles A by lessening damage to articles A, by becoming lodged between the slats and the divider chute or shield member, and improves the accuracy of the count of articles A in each container C.

FIG. 3 shows diagrammatically the apparatus illustrated in FIGS. 1–2 in combination with an apparatus for enabling the filling of containers C with a predetermined count of articles A, shown as tablets. As the slats 12 move downwardly about the axis of the shaft 18, the cavities 24 discharge the articles A into receiving divider chutes 60 extending longitudinally of the slats 12. Each divider chute 60 receives simultaneously the discharge from a predetermined number of cavities 24 of each slat 12. Each divider chute 60 in turn discharges to a chute 62 having an inlet sized to conform to the tapered outlet from the divider chute 60 and a tapered outlet sized to discharge into a container C located below it. The containers C are moved into position below the chutes 62 between guides 64 by a conveyor 66.

The chutes 62 may by stationary and the containers C moved in batches intermittently into receiving position below chutes 62. In such case, the dispensing mechanism may be stopped during each indexing period while filled containers C are moved out of fill position and replaced by empty ones. In an alternative embodiment, the dispensing apparatus is operated continuously and automatic gates (not shown) are provided for retaining the articles A discharged into the divider chutes 60 during the indexing period.

Alternatively, chutes 62 may be mounted for movement in a closed path during which they are located in the position shown in FIG. 3. In such a case, the containers C may be moved, and the dispensing mechanism operated, continuously, with blind slats (i.e., without cavities) interspersed with cavitied slats. Such blind slats (not shown) may be provided with blind openings (closed at the slat face) like openings 32 but deep enough to receive the full injected length of pins 34, thus enabling substitution of blind slats without changing the ejector mechanism.

FIG. 4 diagrammatically shows ejectors adapted for use with slats having dual article holding cavities 24'. In this type, gravity discharge of the articles A from cavities 24' of slats 12' as they pass downwardly about the axis of shaft 18' is prevented by a shield member 68 extending about that axis in proximity to the open ends of cavities 24', until the slats 12' have become substantially fully inverted and are moving out of radial relation to shaft 18'. This enables discharge from the slat cavities 24' into one set of chutes 70 which in turn discharge directly into containers C moved along a slide 72 and a guide 74 by a rotating conveyor worm 76. This arrangement provides a shorter fall for the articles A, as is desirable where they are fragile.

In some arrangements, it may not be practical to locate the ejectors at shaft 18 or 18' so that the ejector mechanism is operative as the articles A are being gravity discharged. In such cases, the ejectors may be located for operation in conjunction with another shaft and sprocket, such as the shaft 78 and sprocket 80 in FIG. 4, located at the rear of the machine of FIG. 1, about which the slats 12' pass to tilt them from an inverted to an upwardly inclined position. Except for the change in location, the ejectors may be the same as in FIG. 2 or 3, so that the pins 34' will eject any articles that failed to discharge at the preceding dispensing station.

While the foregoing has described in detail preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description) but is only limited by the scope of the appended claims.

What is claimed is:

1. A conveyor for an article dispensing apparatus, comprising:

a plurality of holders each having at least one cavity adapted to receive at least one article, each said holder having an open end;

a conveying device adapted to convey said holders around a circuit, said circuit including areas where said holders are conveyed about an axis; and a discharge device positioned at a discharge station and having an arcuate portion facing said open ends of said holders, wherein said open ends of said holders include a surface complementary to said arcuate portion.

2. The conveyor of claim 1, wherein said holders comprise elongated slats connected for movement by said conveying device in a direction transverse to the length of said slats.

3. The conveyor of claim 1, wherein said discharge device comprises an arcuate shield positioned upstream from the discharge station, said surface of each said holder being complementary to said shield for inhibiting articles within said holders from being dispensed at a location other than the discharge station.

4. A conveyor for an article dispensing apparatus, comprising:

a plurality of elongated holders connected for movement in a direction transverse to their lengths, each said holder having a tongue on one side and a groove on another opposite side, each said tongue fitting within a respective said groove of an adjacent said holder; and a conveying device adapted to convey said holders around a circuit, said circuit including areas where said holders are conveyed about an axis.

5. The conveyor of claim 4, wherein each said tongue is sloped and each said groove is dipped to allow relatively unencumbered movement between adjacent holders.

6. The conveyor of claim 4, wherein said holders comprise elongated slats connected for movement in a direction transverse to their length.

7. The conveyor of claim 4, further including a discharge device positioned at a discharge station.

8. The conveyor of claim 7, wherein said discharge device further comprises a shield positioned upstream from the discharge station.

9. A conveyor for an article dispensing apparatus, comprising:

a plurality of elongated holders connected for movement in a direction transverse to their length, each holder having a tongue on one side, a groove on another side; at least one cavity adapted to receive at least one article, and an open end, wherein each said tongue fits within a respective said groove of an adjacent said holder; and a conveying device adapted to convey said holders around a circuit, said circuit including areas where said holders are conveyed about an axis; and a discharge device positioned at a discharge station and having an arcuate portion facing said open ends of said holders, wherein said open ends of said holders include a surface complementary to said arcuate portion.

10. The conveyor of claim 9, wherein said holders comprise elongated slats connected for movement by the conveying device in a direction transverse to the length of said slats.

11. The conveyor of claim 9, wherein said discharge device comprises an arcuate shield positioned upstream from the discharge station, said surface of each said holder being complementary to said shield for inhibiting articles within said holders from being dispensed at a location other than the discharge station.

12. An article dispensing apparatus having a feeding station and a discharge station, comprising:

a conveyor, including:

a plurality of holders each having at least one cavity adapted to receive at least one article, each said holder having an open end; and a conveying device adapted to convey said holders around a circuit, said circuit including areas where said holders are conveyed about an axis;

an article feeding device adapted to feed articles to said holders at the feeding station; and a chute positioned at the discharge station and having an arcuate portion facing said open ends of said holders, wherein said open ends of said holders include a surface complementary to said arcuate portion for inhibiting articles within said holders from being dispensed at a location other than the discharge station.

13. The article dispensing apparatus of claim 12, further including a plurality of pins each being capable of extending into and retracting out of said cavities through an aperture in said holders.

14. The article dispensing apparatus of claim 12, wherein said holders comprise elongated slats connected for movement by the conveying device in a direction transverse to the length of said slats.

15. The article dispensing apparatus of claim 12, further comprising an arcuate shield positioned upstream from the discharge station, said surface of each said holder being complementary to said shield for inhibiting articles within said holders from being dispensed at a location other than the discharge station.

16. An article dispensing apparatus having a feeding station and a discharge station, comprising:

a conveyor, including:

a plurality of elongated holders connected for movement in a direction transverse to their length, each holder having a tongue on one side and a groove on another side; and a conveying device adapted to convey said holders around a circuit, said circuit including areas where said holders are conveyed about an axis; and an article feeding device adapted to feed articles to said holders at the feeding station;

wherein each said tongue fits within a respective said groove of an adjacent said holder allowing said holders to ride in close conformity around said circuit.

17. The article dispensing apparatus of claim 16, further including a plurality of pins each being capable of extending into and retracting out of said cavities through an aperture in said holders.

18. The article dispensing apparatus of claim 16, wherein each said tongue is sloped and each said groove is dipped to allow relatively unencumbered movement between adjacent holders.

19. The article dispensing apparatus of claim 16, wherein said holders comprise elongated slats connected for movement in a direction transverse to their length.

20. The article dispensing apparatus of claim 16, further including a discharge device positioned at a discharge station.

21. The article dispensing apparatus of claim 20, wherein said discharge device comprises a shield positioned upstream from the discharge station.

22. A method of dispensing articles at a discharge station, comprising the steps of:

feeding articles to an article dispensing machine at a feeding station;

conveying the articles to a discharge station having a chute with an arcuate portion, wherein the article dispensing machine includes a plurality of open-ended slats having cavities for holding the articles; and inhibiting the articles from being dispensed from the cavities prior to the discharge station, wherein the slats are conveyed about a radius as they approach the discharge station such that the open ends of the slats become inverted, said slats having an open end surface complementary to the arcuate portion of the chute.

23. The method of claim 22, wherein the inhibiting step includes providing slats having a convex said open end surface complementary to the arcuate portion of the chute, said arcuate portion being concave.

24. The method of claim 23, further including providing ejector pins through an opening in the slats for dislodging any articles stuck therein.

25. The method of claim 23, wherein the inhibiting step includes providing a concave shield member at a position about the radius, said open end surfaces being complementary to said shield member.

26. The method of claim 22, further including providing each slate with a tongue on one side and a groove on another opposite side, each said tongue fitting within a respective said groove on an adjacent said slat to provide relatively unencumbered movement between the slats.

27. A method of dispensing articles at a discharge station, comprising the steps of:

feeding articles to an article dispensing machine at a feeding station;

conveying the articles to a discharge station, wherein the article dispensing machine includes a plurality of open-ended slats having cavities for holding the articles, said slats further having a tongue on one side and a groove on another opposite side, each said tongue fitting within a respective said groove on an adjacent said slat to provide relatively unencumbered movement between the slats; and discharging the articles at the discharge station.

28. The method of claim 27, wherein the discharging step includes providing a chute at the discharge station.

29. A conveyor for an article dispensing apparatus comprising:

a plurality of elongated holders connected for movement in a direction transverse to their lengths, each said holder having a tongue on one side and a groove on another opposite side, each said tongue fitting within a respective groove of an adjacent holder;

a conveying device adapted to convey said holders around a circuit, said circuit including areas where said holders are conveyed about an axis; and a discharge device positioned at a discharge station.

* * * * *